United States Patent [19]

Herb et al.

[11] 4,320,857

[45] Mar. 23, 1982

[54] DEVICE FOR THE MELTING AND MEASURED DISCHARGE OF A THERMOPLASTIC ADHESIVE

[75] Inventors: Armin Herb, Peissenberg; Erich Leibhard, Munich, both of Fed. Rep. of Germany

[73] Assignee: Hilti Aktiengesellschaft, Schaan, Liechtenstein

[21] Appl. No.: 122,848

[22] Filed: Feb. 20, 1980

[30] Foreign Application Priority Data

Feb. 22, 1979 [DE] Fed. Rep. of Germany ..... 2906922

[51] Int. Cl.[3] ..... B67D 5/62

[52] U.S. Cl. ..... 222/146 HE; 222/497; 222/518; 137/539

[58] Field of Search ..... 222/146 HE, 495, 496, 222/497, 511, 512, 518; 137/539

[56] References Cited

U.S. PATENT DOCUMENTS

| | | | |
|---|---|---|---|
| 3,179,300 | 4/1965 | Davidson et al. | 222/497 X |
| 3,437,082 | 4/1969 | Beuwkamp et al. | 137/539 X |
| 3,743,142 | 7/1973 | Elliott et al. | 222/146 HE |
| 4,033,484 | 7/1977 | Ornsteen | 222/146 HE |
| 4,091,839 | 5/1978 | Donner | 137/539 X |

*Primary Examiner*—Joseph J. Rolla

*Attorney, Agent, or Firm*—Toren, McGeady & Stanger

[57] ABSTRACT

In a device for the melting and measured discharge of a thermoplastic adhesive, the adhesive material is melted within a melting chamber and then flows out through a discharge nozzle. The discharge nozzle contains a spring biased valve body for blocking flow out of the melting chamber until the biasing force is overcome. If the spring fails and cannot return the valve body into position to seal the melting chamber, the discharge nozzle is arranged to prevent the valve body from blocking the flow of the melted adhesive material through and out of the discharge nozzle.

3 Claims, 5 Drawing Figures

Fig. 5 (B-B)
A
B
B

DEVICE FOR THE MELTING AND MEASURED DISCHARGE OF A THERMOPLASTIC ADHESIVE

SUMMARY OF THE INVENTION

The present invention is directed to a device for the melting and dosed or measured discharge of a thermoplastic adhesive from a melting chamber, a discharge nozzle is connected to the outlet from the melting chamber and contains a spring loaded valve for sealing flow from the melting chamber until the spring load is overcome so that the melted adhesive material can flow from the melting chamber through the discharge nozzle out of the device.

Known devices of the type described above include a safety member for blocking flow. This member prevents any accidental flow of the melted material out of the discharge nozzle. One-way valves are known for this purpose and consist of a ball shaped valve body biased by a compression spring into the flow sealing position. The compression spring is designed so that the valve opens as soon as a certain pressure is reached in the melting chamber. This pressure is developed when the adhesive material is fed in the solid state into the melting chamber. When the supply of the adhesive material to the chamber is stopped, the pressure in the chamber falls below the certain value required to overcome the spring load and the valve closes and prevents any undesired flow of the molten adhesive material out of the melting chamber into the discharge nozzle for passage out of the device.

In the operation of such a device the valve is continuously being opened and closed. Each operating cycle results in a load change on the spring biasing the valve body. Accordingly, it is a usual occurrence for the spring to fail through wear or breakage. If such failure occurs, in the known devices, the valve body is displaced toward the outlet from the discharge nozzle and the flow passage through the nozzle is blocked. As a result, when such a failure occurs the melted adhesive material cannot be discharged from the device. Therefore, since the device is no longer operative, it must be emptied, taken apart and the spring replaced. Repair of the device under such circumstances leads to long periods of down time.

Therefore, it is the primary object of the present invention to provide an improvement which permits the continued use of the device even after the failure of the spring which biases the valve body.

In accordance with the present invention the discharge nozzle is arranged to form a stop which prevents the valve body from reaching a position where it blocks flow through the discharge nozzle out of the device. While the discharge nozzle prevents the valve body from blocking flow, a residual cross-sectional area is always present permitting flow around the valve body to the outlet from the discharge nozzle. If the melted material tends to drip out of the discharge nozzle when the feed mechanism is not being used, such dripping can be compensated in a simple manner by positioning the outlet end of the discharge nozzle above the melting chamber.

The construction of the discharge nozzle for securing the valve body so that it does not block flow can be achieved in different ways. In one particularly advantageous arrangement, a portion of the spring which biases the valve body into the normal closed position can act as a stop. Normally, a helical spring is used with turns or coils of varying pitch and diameter. If the spring fails, the individual turns collapse against one another. Because of the varying dimensions of the individual coils, a residual open cross section is provided when the spring is compressed into a block-like form. The melted material can flow around the valve body and through the spring to the outlet of the discharge nozzle. Using the same general principle, the spring can be provided with parts of the different spring stiffnesses so that an open flow path is maintained even when the spring fails and collapses.

In another embodiment utilizing a helically coiled spring at least one coil at the opposite end of the spring from the valve body is bent so that it extends transversely of the other coils, that is, generally in the axial direction of the spring. If the spring fails, this transversely extending coil prevents the combination of the valve body on the spring from blocking flow through the discharge nozzle. The transversely extending coil can be formed as an integral part of the spring. Such a spring can be produced especially economically, since the end coil or turn of a conventional compression spring can be bent transversely of the other coils to provide the desired arrangement. In still another advantageous embodiment the stop for the valve body can be arranged within the discharge nozzle. As an example, an inwardly directed pin can be provided in the passageway through the discharge nozzle for preventing the valve body from being displaced into a position where it blocks flow through the discharge nozzle.

In yet another embodiment the valve body can be retained within one passageway with another bypass passageway provided for maintaining flow through the discharge nozzle even though the spring fails.

In a device of the type in which the present invention is used, the valve body as well as the biasing spring are small and, as a result, are difficult to assemble. To simplify replacement it is expedient if the valve is formed as part of a sleeve held in the passageway through the discharge nozzle with the sleeve forming a stop for the valve body so that it does not block flow through the sleeve and arm out of the discharge nozzle. If the spring breaks or fails, the sleeve can be removed and a new sleeve inserted so that a new valve is provided. In other words, the sleeve forms a valve unit which simplifies replacement. The stop in the sleeve can be formed by one of a number of inwardly bent lugs which prevent the ball from closing off flow through the discharge nozzle.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawings:

FIG. 5 is a section of the discharge nozzle shown in FIG. 4 and taken along the line B—B.

DETAILED DESCRIPTION OF THE INVENTION

Figures 1, 2, 3, 4:
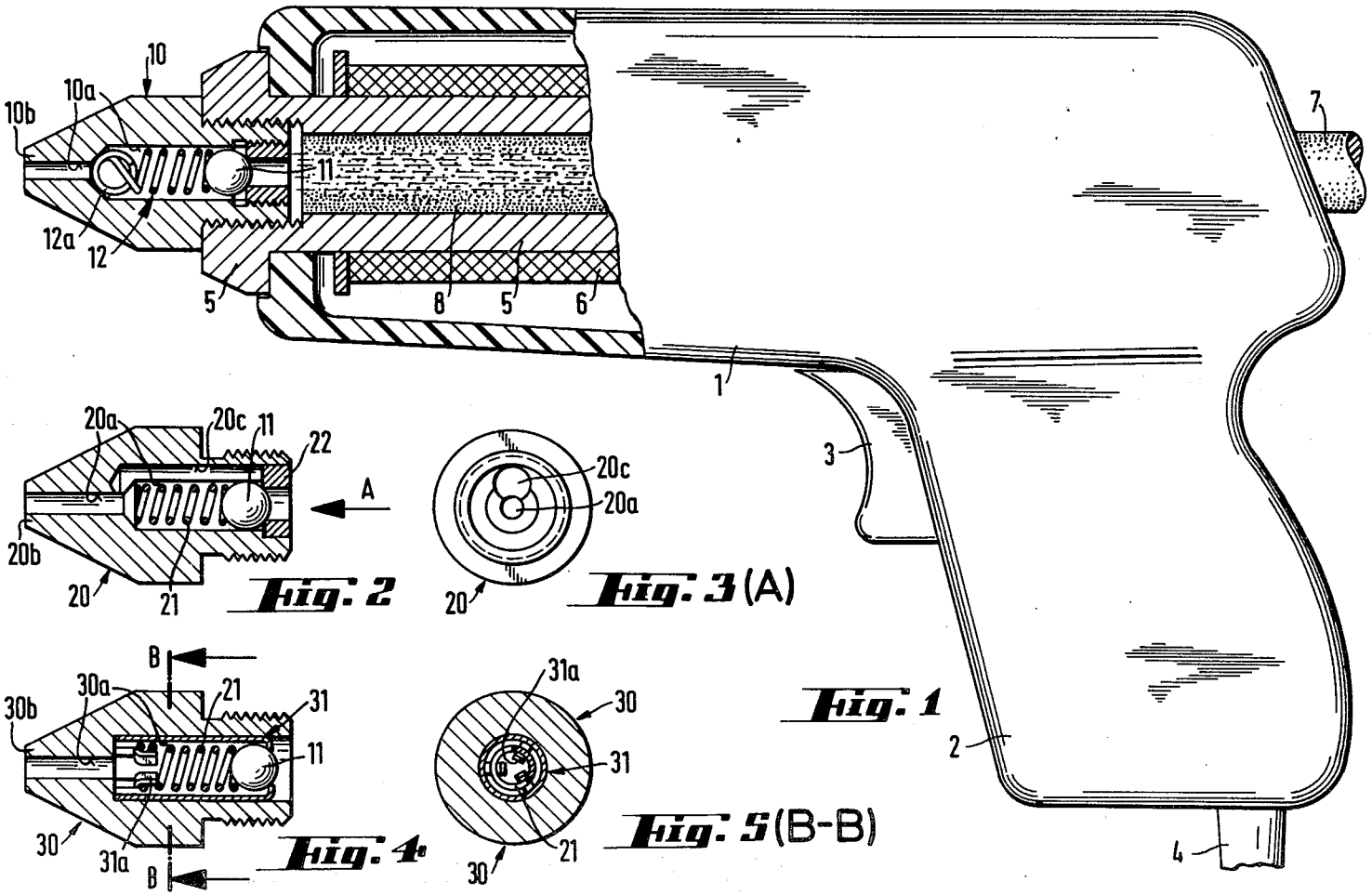
FIG. 1 is a side view, partly in section, of a device illustrating one embodiment of the present invention.
FIG. 2 is a sectional view of another embodiment of the discharge nozzle for the device shown in FIG. 1.
FIG. 3 is an end view viewed in the direction of arrow A of the discharge nozzle illustrated in FIG. 2.
FIG. 4 is a sectional view of yet another embodiment of the discharge nozzle for the device shown in FIG. 1.

In FIG. 1 a device is shown for the melting and measured discharge of a thermoplastic adhesive material. The device has the appearance of a hand gun consisting of a housing 1 with a handle 2 extending downwardly from its rearward end, that is the right end as viewed in FIG. 1. A trigger-like pushbutton 3 is located in the handle 2 and an electrical connection line 4 is shown leading into the bottom of the handle. A melting chamber 5 is located within the housing 1 extending axially through the housing from the right to the left as viewed in FIG. 1. Melting chamber 5 is laterally enclosed by a heating coil 6. When the trigger or pushbutton 3 is squeezed, a solid rod of the thermoplastic adhesive material is introduced into the right hand end of the melting chamber by means of a known advancing mechanism, not shown. The melting chamber 5 projects outwardly from the left or front end of the housing 1. A discharge nozzle 10 is screwed into the melting chamber at the front end of the housing. The end of the melting chamber 5 at the front end of the housing forms its outlet end. The discharge nozzle 10 has an axially extending passageway 10*a* extending from the outlet end of the melting chamber to the front or outlet end 10*b* of the discharge nozzle. The passageway 10*a* has a first axially extending portion of larger diameter extending from the melting chamber and a second axially extending portion which extends between the outlet end 10*b* and the end of the larger diameter portion spaced from the melting chamber.

In the larger diameter portion of the passageway 10*a*, a check or one-way valve is positioned including a ball-shaped body 11 and a compression spring 12. The compression spring 12 biases the valve body 11 against a seat located at the outlet end of the melting chamber so that flow out of the chamber is blocked. When the solid rod of adhesive material is moved into the inlet end of the melting chamber 5, a certain pressure is developed in the melted material within the chamber. When this pressure reaches a certain level, the valve body 11 is displaced in the leftward direction, as viewed in FIG. 1, toward the outlet end 10*b* of the discharge nozzle and the melted adhesive material 8 can flow out of the chamber 5 through the passageway 10*a* in the discharge nozzle to the outlet end 10*b*. The valve body 11 and the spring 12 are sized so that the melted material can pass around them through the passageway 10*a*.

The spring 12 is formed of a number of coils extending in planes transversely of the axial direction of the spring, that is, the axial direction of the passageway 10*a*. The last coil 12*a* of the spring 12, however, is bent so that it extends in the axial direction of the spring approximately perpendicularly of the other coils. If the spring 12 fails and is unable to return the valve body 11 back into sealing engagement with the outlet end of the melting chamber 5, the last coil 12*a* prevents the spring and valve body from being moved into a position where the smaller diameter portion of the passageway 10*a* is blocked so that the melted adhesive material cannot flow out of the discharge nozzle. Accordingly, with the arrangement shown in FIG. 1, even though the spring 12 fails, the melted adhesive material can continue to flow around the ball and spring out through the smaller diameter portion of the passageway 10*a*.

In FIG. 2 a discharge nozzle 20 is illustrated displaying another embodiment of the invention. The discharge nozzle 20 has an axially extending passageway 20*a* having a larger diameter portion extending from the melting chamber with a smaller diameter portion extending from the end of the larger diameter portion spaced from the melting chamber to the outlet end 20*b* of the nozzle. The larger diameter portion of passageway 20*a* contains a ball-shaped valve body 11 and a helical compression spring 21 biasing the valve body against a valve seat 22 which is located at the outlet end of the melting chamber. To avoid blockage of flow through the discharge nozzle by the valve body 11 in the event of failure of the spring 21, the discharge nozzle is provided with a bypass passageway 20*c* located in parallel relation with the larger diameter portion of the passageway 20*a* and extending for the axial length of the larger diameter portion and extending forwardly from it into the region of the smaller diameter portion of the passageway.

As can be seen in FIG. 3, the bypass passageway 20*c* is in open communication with the flow passageway 20*a* and also with the smaller diameter portion located forwardly of the larger diameter portion. In the event that the spring 21 should fail, the valve body 11 is held or stopped by the discharge nozzle itself being retained within the larger diameter portion of the passageway 20*a*. Though flow directly from the larger diameter portion into the smaller diameter portion of the passageway 20*a* is blocked by the combination of the failed spring 21 and the valve body 11, the melted adhesive material flowing out of the melting chamber flows into the bypass passageway 20*c* and forwardly of the larger diameter portion of the passageway 20*a* enters into the smaller diameter portion and continues out through the outlet end 20*b* of the nozzle. In this arrangement the nozzle body provides the stop for the valve body while the bypass passageway 20*c* permits continued flow of the melted adhesive material.

In FIG. 3 an end view of FIG. 2 is provided viewing the discharge nozzle 20 in the direction of the arrow A. The passageway 20*a* with both its larger diameter and smaller diameter portions can be seen with the bypass passageway 20*c* arranged eccentrically of both of the portions. It can be seen that the bypass passageway 20*c* is in direct open communication with both of the portions of the passageway 20*a*. In this figure, the valve body 11, the spring 21 and the valve seat 22 have been omitted for the sake of clarity.

FIG. 4 displays still another embodiment of a discharge nozzle 30 incorporating the present invention. Discharge nozzle 30 has a through passageway 30*a* similar to that in FIG. 1 with a larger diameter portion extending from the melting chamber 5 and a smaller diameter portion continuing from the larger diameter portion through the outlet end of the nozzle. Within the larger diameter portion of the passageway 30*a* a sleeve 31 is fitted with the sleeve extending in coaxial relation with the passageway. A ball-shaped valve body 11 is positioned within the sleeve 31 along with a compression spring 21 which biases the valve body in the direction toward the melting chamber, that is the right hand end as viewed in FIG. 4. The right hand end of the sleeve is bent inwardly forming a seat for the valve body 11 so that is can block flow out of the melting chamber. At the other end of the sleeve, that is the end adjacent the smaller diameter portion of the passageway 30*a*, a number of lugs 31*a* are bent out of the sleeve inwardly into its interior for holding the end of the spring 21. The lugs 31*a* act as a stop for the spring 21 and the valve body in the event the spring fails. The spring and valve body are sized so that the melted adhesive material can flow around the valve body end spring and out through the outlet end 30*b* of the discharge nozzle 30. When the spring fails, the lugs maintain the spring and ball out of blocking contact with the transition from the larger diameter portion to the smaller diameter portion of the passageway 30*a* so that flow of the melted adhesive material can continue.

In the sectional view of the discharge nozzle 30 shown in FIG. 5, the inwardly bent lugs 31*a* can be seen projecting inwardly of the spring coils. As can be seen in FIG. 5, the lugs 31*a* support the spring 21 under normal operating conditions and provide a stop for the spring and the valve body in the event the spring fails.

While specific embodiments of the invention have been shown and described in detail to illustrate the application of the inventive principles, it will be understood that the invention may be embodied otherwise without departing from such principles.

What is claimed is:

1. Device for the melting and measured discharge of a thermoplastic adhesive material comprising an elongated melting chamber having an inlet at one end and an outlet at the other end thereof with said inlet and outlet spaced apart in the elongated direction thereof, a discharge nozzle fitted to the outlet end of said melting chamber, said discharge nozzle being axially elongated and having an inlet at one end thereof in communication with the outlet end of said melting chamber for receiving melted thermoplastic material therefrom and an outlet end for discharging the melted thermoplastic material from said nozzle, a valve located within said discharge nozzle comprising a valve body positioned at the inlet end thereof and means for biasing said valve body into sealing contact with the inlet into said discharge nozzle for preventing flow of the melting thermoplastic material into said discharge nozzle until a force is applied against said valve body for displacing said valve body against said biasing means for permitting flow of the melted thermoplastic material into said discharge nozzle for flow from the outlet end thereof, wherein the improvement comprises means within said discharge nozzle for maintaining the flow of the melted thermoplastic material from the inlet end to the outlet end of said discharge nozzle when said biasing means fail and are unable to return said valve body into position for sealing off flow from said melting chamber into said discharge nozzle, said discharge nozzle forming an axially elongated passageway extending from said inlet end thereof toward said outlet end for flowing the melted thermoplastic material from said melting chamber toward said outlet end of said nozzle, said biasing means comprising an elongated spring retained within and extending in the axial direction of said passageway, and said spring arranged to form a stop for spacing said valve body from the end of said passageway opposite said inlet end of said discharge nozzle so that said valve body is held from seating in the opposite end of said passageway and blocking flow out of said discharge nozzle, said spring being a helical spring having a plurality of first turns each located in a plane extending transversely of the axis of said passageway and at least one second turn located at the end of said spring spaced from the inlet end of said discharge nozzle for axially spacing said spring and valve body from the opposite end of said passageway so that even upon failure of said spring the combination of said spring and valve body does not block flow of the melted thermoplastic material through and out of said passageway.

2. Device, as set forth in claim 1, wherein said valve body having a smaller diameter than said passageway so that the melted thermoplastic material can flow around said ball and through said spring to the opposite end of said passageway for flow therefrom through said outlet end of said discharge nozzle.

3. Device, as set forth in claims 1 or 2, including means at the outlet end of said melting chamber for forming a seal seat for said valve body for preventing leakage from said melting chamber until said valve body is displaced from said seal seat against the holding action of said biasing means.

* * * * *

UNITED STATES PATENT OFFICE

CERTIFICATE OF CORRECTION

Patent No. 4,320,857 Dated March 23, 1982

Inventor(s) Armin Herb, et al

It is certified that error appears in the above-identified patent and that said Letters Patent are hereby corrected as shown below:

In the heading of the Patent [30] should read as follows:

[30] Foreign Application Priority Data

Feb.22, 1979 [DE] Fed.Rep. of Germany.....2906992

Signed and Sealed this

*Eighteenth* Day of *May 1982*

[SEAL]

*Attest:*

GERALD J. MOSSINGHOFF

*Attesting Officer*

*Commissioner of Patents and Trademarks*